United States Patent [19]

Murphy

[11] 4,149,712

[45] Apr. 17, 1979

[54] PHYSICAL EXERCISE APPARATUS

[76] Inventor: Richard J. Murphy, Rte. #1, Box 387-K, Fontana, Wis. 53125

[21] Appl. No.: 833,486

[22] Filed: Sep. 15, 1977

[51] Int. Cl.[2] ..... A63B 7/04

[52] U.S. Cl. ..... 272/112; 272/113; 4/172

[58] Field of Search ..... 272/62, 63, 111, 112, 272/113, 93; 14/13, 14, 15, 27, 28, 75, 22; 52/126, 93; 5/81 R, 81 B, 88; 4/172, 172.11

[56] References Cited

U.S. PATENT DOCUMENTS

| | | | |
|---|---|---|---|
| 530,265 | 12/1894 | Fenn | 14/14 X |
| 936,107 | 10/1909 | Floyd | 5/88 |
| 2,339,098 | 1/1944 | Nagin | 14/13 |
| 2,884,252 | 4/1959 | Thompson | 272/62 X |
| 2,929,627 | 3/1960 | Scanlon | 272/62 X |
| 3,653,658 | 4/1972 | Robertson | 272/62 X |
| 3,716,232 | 2/1973 | Johnson et al. | 272/62 X |
| 3,858,371 | 1/1975 | Averill | 52/126 |
| 4,006,567 | 2/1977 | Flannery | 52/126X |

FOREIGN PATENT DOCUMENTS

| | | | |
|---|---|---|---|
| 2,315,009 | 10/1974 | Fed. Rep. of Germany | 272/93 |

*Primary Examiner*—Richard C. Pinkham
*Assistant Examiner*—William R. Browne
*Attorney, Agent, or Firm*—Edward D. Gilhooly

[57] ABSTRACT

An apparatus for strengthening the bodies of individuals including a hexagon shaped grid or rack positioned above a surface of water such as created by a swimming pool. The hexagon shape of each component of the grid permits an individual to grasp alternately individual segments of the grid and progress in any direction relative to the water, either during exercise or specially designed games utilizing the improved features of the apparatus. The apparatus is particularly useful in connection with physical development of handicapped children. The grid itself is adjustably mounted with respect to the level of water permitting it to be raised or lowered to different heights above the water dependent on the age of the participant or his or her stage of development.

5 Claims, 4 Drawing Figures

PHYSICAL EXERCISE APPARATUS

BACKGROUND OF THE INVENTION

This invention relates in general to physical development and in particular, to an improved apparatus and method for strengthing the body of individuals.

More specifically, the invention relates to a unique grid-like structure in the form of a rack which is suspended above the surface of water such as in a swimming pool whereby an individual can grasp segments of the grid above him while in the water and can move relative to the water in any direction by grasping other segments. The grid is adjustably supported above the water permitting it to be raised or lowered depending on the age of the individual and his or her progress in development.

In the area of physical development of individuals, it has long been recognized that it is important to develop strength and cardio-respiratory efficiency to contribute to good health. This is particularly true in children whose level of development at a young age influences his and her health as an adult. Physical development of children is not only important in the development of normal children but is essential to physically handicapped or mentally retarded children as well to provide a suitable means to overcome their handicaps with a strong physical development program. The important factor in physical development is whether the technique utilized contains motivating elements to encourge the development of the child or adult, whether normal or handicapped.

Many prior art devices have been relied upon to achieve physical development of individuals. But generally such devices have been deficient in several aspects. Many of the prior art devices simply can not be used by handicapped children. Other devices utilized for handicapped individuals, do not on the other hand, provide a sufficient degree of challenge to the normally developed individual. Moreover, none of the prior art development techniques achieve upper body development in individuals in conjunction with the natural buoyancy of water as an aid in support of the individual. Therefore, it is desirable to provide an improved apparatus to overcome such problems and aid in the development of an individual, normal or handicapped, in an effective and motivating manner.

SUMMARY OF THE INVENTION

It is, therefore, an object of this invention to improve the apparatus for development of the body of an individual.

A further object of this invention is to achieve development of an individual in conjunction with a body of water.

Still another object of the invention is to physically develop the upper bodies of individuals by the use of an improved grid or rack suspended above the body of water.

A still further object of the invention is to adjustably suspend a grid or rack above the water dependent on the age and physical condition of the individual.

These and other objects are attained in accordance with the present invention wherein there is provided an improved grid or rack which is supported above a body of water such as present in a swimming pool. The grid is composed of interconnected sections in the form of a plurality of hexagons which permit a user to grasp one or two segments of a section at a time and move in any direction relative to the water by grasping other segments in the same or adjacent section. When grasping the grid, the user is also supported by the buoyancy of the water thus permitting handicapped individuals to use the apparatus as well as aiding normally developed persons. Certain games can be designed in connection with the grid to provide a high motivation and entertainment incentive for physical development and endurance.

The grid is so designed that a user can sequentially grasp segments to move relative to the water or grasp the segments in a stationary position for pure raising exercises. The invention of the application is particularly useful in conjunction with physically handicapped children since presence of water aids their use of the apparatus. But the invention is in no way limited to use by handicapped individuals whereby normally developed children or adults can enjoy the use of the rack for a multitude of activities whereby the development of their upper body may be significantly improved through a regular program of use of the apparatus of the invention.

In essence, the apparatus incorporating the teachings of the invention enable individuals to be suspended above water, manipulate themselves from place to place, engage in competitive activities resulting in significant physical development. Since the buoyancy created by the water below contributes to their support, individuals of diverse ages and physical abilities can utilize the teaching invention by the simple adjustment of the height of the grid or rack above the water.

BRIEF DESCRIPTION OF THE DRAWINGS

Further objects of the invention together with additional features contributing thereto and accuring therefrom, will be apparent from the following description of several embodiments of the invention when read in conjunction with the accompanying drawings.

DESCRIPTION OF THE PREFERRED EMBODIMENTS

Figure 1:
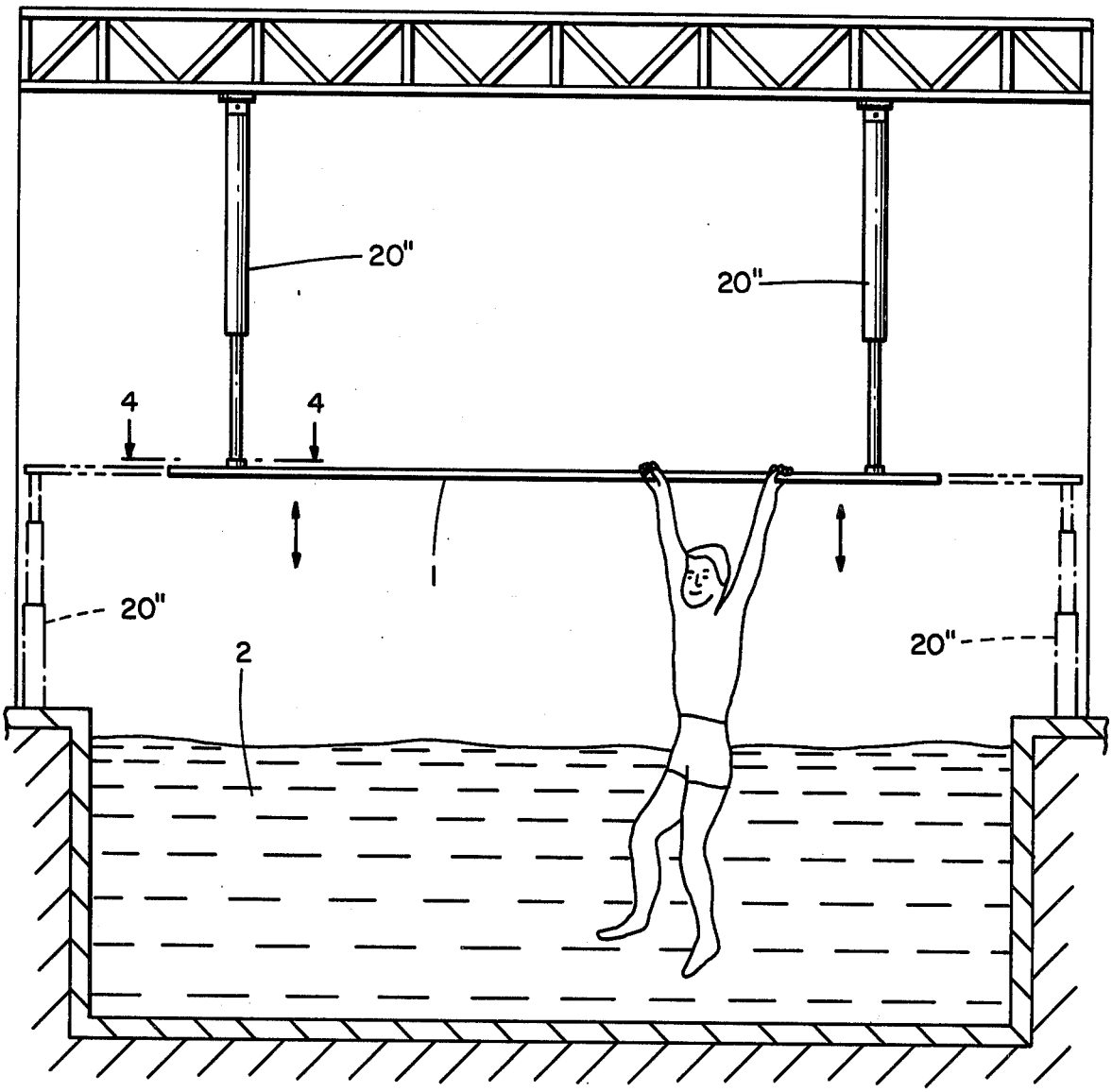
FIG. 1 is a side schematic view of the apparatus of the invention suspended above a body of water by means of a pulley and cable system.

Referring to FIG. 1 there is illustrated a first embodiment of the apparatus for physical development of an individual in which a novel grid or rack 1 is suspended above a body of water 2 which may be, for example, a swimming pool. Rack 1 is shown in FIG. 1 as being suspended by a plurality of cables 3 attached to the structure whereby the cables can lift or lower the rack as desired. Such movement can be achieved by use of a typical crank 4 connected to the cable whereby a pulley 5 can be positioned on the ceiling or other structure above the pool. By rotating crank 4 rack 1 can be lowered or raised dependent of the physical development of a user. A plurality of such cables can be attached at different position on to the rack to achieve desired upward and downward movement and support of the rack for optimum results. A respective cable can be attached to the rack by any conventional technique such as by an eye bolt 10 threadedly connected in one or more holes 11 passing through the body of the rack 1.

Figure 2:
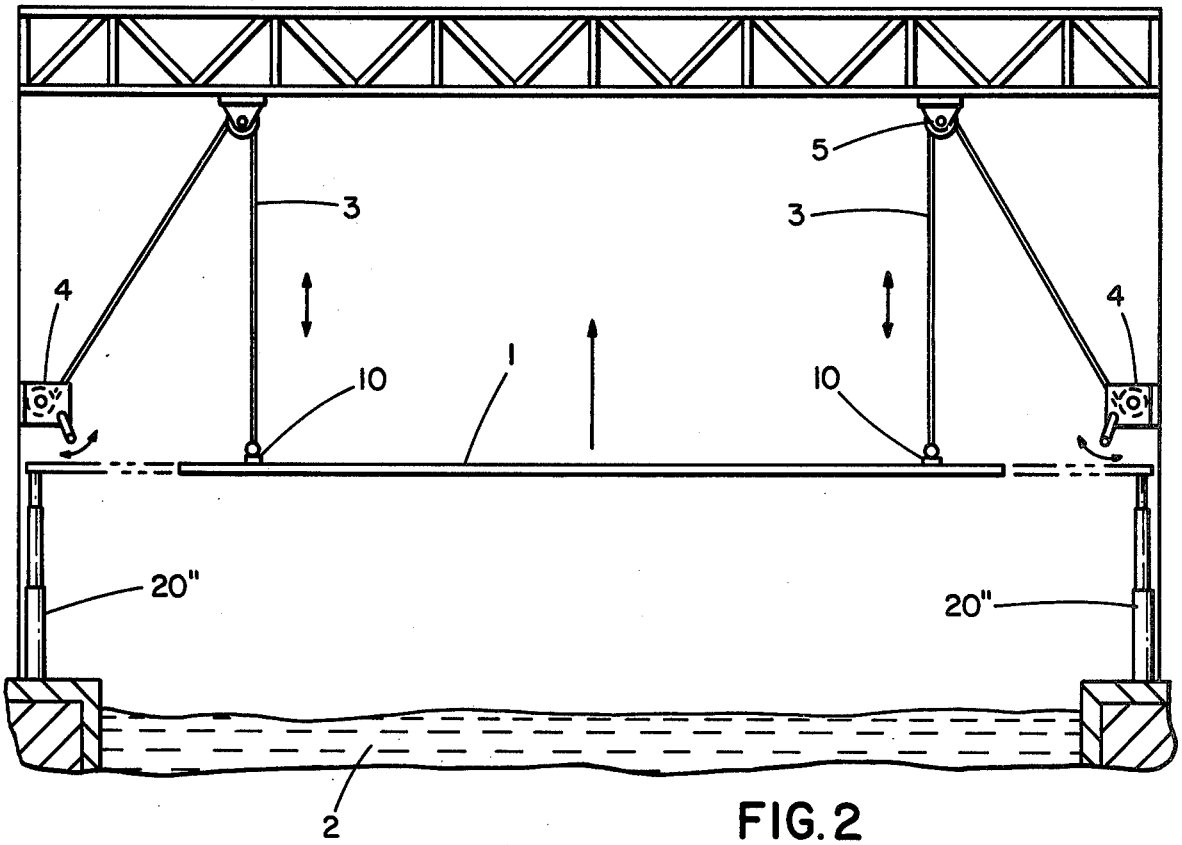
FIG. 2 is a second embodiment of the invention of FIG. 1 in which a hydraulic means is utilized to suspend the apparatus of the invention.

Referring to FIG. 2 there is illustrated a second embodiment of the apparatus of the invention being used by an individual in which rack 1 is supported for adjustable positioning relative to the water by a plurality of hydraulic cylinders 20″ supported above and pressurized by any suitable pressure source and regulated by control means (not shown), which can be conveniently positioned at any point. Hydraulic rams 20″ can be coupled to holes 11 formed in the rack by an elongated extensible end 23 of the ram in threaded relation to the holes. Alternatively, the rack may be supported on the edge of the swimming pool by hydraulic cylinders shown in phantom in FIG. 2.

Figure 4:
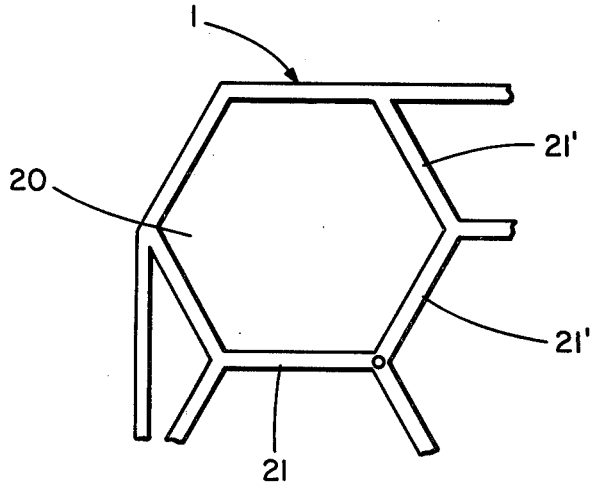
FIG. 4 is a top schematic illustration showing one section of the grid or rack of FIG. 3.
Figure 3:
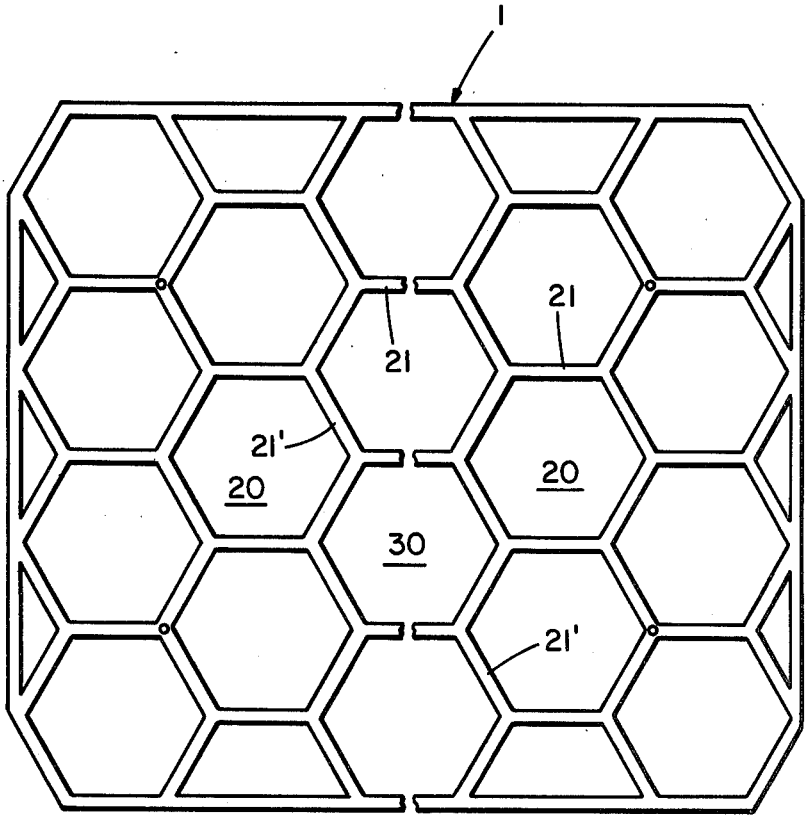
FIG. 3 is a partial schematic illustration of the grid or rack of the apparatus of FIG. 1.

Referring now to FIGS. 3 and 4 the details of the rack or grid 1 is clearly illustrated. Rack 1 includes a plurality of interconnected sections 20 having cylindrical cross-sections and the sections are in the form of hexagons with six segments of legs 21 whereby the legs of one section also acts as a leg to an adjacent hexagonal section, if not an edge segment. The rack can be fabricated from any suitable materials such as metal, cable or a plastic, in solid or tubular form, and as a unit should possess sufficient strength to support the weight of a number of participants who may be utilizing the system for development. The plurality of segments may be, for example, interconnected by brackets or other suitable means (not shown) or alternately, be manufactured as a unitary structure.

The dimensions of the legs or segments 21 of the rack depend largely on the size and age of the participants but it should be of a dimension so that a user can readily grasp two opposite legs 21′ separated by a section. When a user utilizes the device in this manner, he may pull himself up for a straight exercise by which his head can raise into the opening 30 formed by the hexagon section 20 which separates the two legs. In practice, legs 21 can for example, be of a length of 10 to 12 inches whereby the diagonal width of a section is 20 to 24 inches.

The rack can be raised and lowered relative to the water whereby higher the rack, greater the effort required on the part of a participant. It also should be apparent that because of the buoyancy of the water beneath the rack, the more underdeveloped the group using the rack 1, the higher that the water level should be on the body. Generally, the rack is positioned parallel to the water in a horizontal plane, but can also be a sloped orientation, if desired.

Because of the unique design of the rack created by its hexagonal sections, a user can suspend himself above the water and virtually move in any direction by grasping a leg of a selected section. This capability permits the device to be used for a variety of exercises, games and the like beyond just a straight lifting effort. In use of the apparatus, a participant thereby increases the strength of his body, particularly the upper portion, and his overall endurance. The individual may also achieve exercise of his or her legs by swinging up to the rack when suspended therefrom.

Countless games and activities can be done with the apparatus including games involving balls to kick or throw, races, gymnastics, and the like. Because of the improved design of rack, each activity strengthens the individual providing both enjoyment and motivation.

The apparatus achieves upper body development of children through the play of entertaining games and competition, even if the child is handicapped or mentally retarded. Currently, not one team game or sport is available to children to attain such upper body development which is possible in using the invention of the application. The amount of development can be varied by the simple technique of adjusting height of the rack above the water.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that this invention not be limited to the particular embodiments disclosed as the best modes contemplated for carrying out this invention, but that the invention will include all embodiments falling within the scope of the appended claims.

What is claimed is:

1. An apparatus for the physical development of individuals comprising:

rack means adapted to be grasped by an individual;

support means for suspending the rack means above a body of water;

said rack means having a plurality of segments by which at least one individual can be suspended in contact with the water;

said segments being positioned adjacent each other to permit said at least one individual to move relative to the rack by alternately grasping selected ones of the segments; and said rack means comprises a plurality of interconnected hexagons formed by the plurality of segments.

2. The apparatus of claim 1 wherein said support means adjustably supports said rack means to permit the rack means to be positioned at different vertical heights above the water.

3. The apparatus of claim 2 wherein said support means includes a plurality of cables operatively coupled to the support means.

4. The apparatus of claim 2 wherein said support means includes at least one pressurized fluid cylinder, said fluid cylinder supporting a downwardly extensible member for relative movement, said extensible member being operatively coupled to the rack means for suspension thereof.

5. The apparatus of claim 1 wherein said plurality of segments possess a circular cross-section.

* * * * *